US009643430B2

(12) United States Patent
Kato et al.

(10) Patent No.: US 9,643,430 B2
(45) Date of Patent: May 9, 2017

(54) PRINTING APPARATUS AND PARTITION SHEET OUTPUT METHOD

(71) Applicant: Seiko Epson Corporation, Tokyo (JP)

(72) Inventors: Kazuhisa Kato, Matsumoto (JP); Seiya Hayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/994,443

(22) Filed: Jan. 13, 2016

(65) Prior Publication Data

US 2016/0214406 A1 Jul. 28, 2016

(30) Foreign Application Priority Data

Jan. 26, 2015 (JP) ..... 2015-012139

(51) Int. Cl.

| | |
|---|---|
| ***B41J 11/00*** | (2006.01) |
| ***B65H 33/04*** | (2006.01) |
| ***B65H 33/18*** | (2006.01) |
| ***G03G 15/00*** | (2006.01) |

(52) U.S. Cl.

CPC ..... *B41J 11/002* (2013.01); *B65H 33/04* (2013.01); *B65H 33/18* (2013.01); *G03G 15/655* (2013.01); *B65H 2701/18267* (2013.01); *G03G 2215/00894* (2013.01)

(58) Field of Classification Search

CPC ..... B65H 33/04; B65H 33/18; B65H 2701/18267; B65H 33/16; B65H 33/10; B65H 33/00; G03G 15/655; G03G 2215/00894

See application file for complete search history.

(56) References Cited

U.S. PATENT DOCUMENTS

| | | | | |
|---|---|---|---|---|
| 2006/0228137 | A1* | 10/2006 | Steele | G03G 15/655 399/382 |
| 2008/0001340 | A1* | 1/2008 | Yamamoto | B65H 33/04 270/58.31 |
| 2009/0201534 | A1* | 8/2009 | Truong | G03G 15/655 358/1.15 |
| 2012/0056928 | A1* | 3/2012 | Powers | B41J 2/2146 347/19 |

FOREIGN PATENT DOCUMENTS

| | | | | |
|---|---|---|---|---|
| JP | 11-292381 | * | 10/1999 | B65H 33/04 |
| JP | 11-292381 A | | 10/1999 | |

* cited by examiner

*Primary Examiner* — Henok Legesse
(74) *Attorney, Agent, or Firm* — Workman Nydegger

(57) ABSTRACT

A printing apparatus includes a drying unit that dries a medium, a controller that controls to output a partition sheet as a partition of the medium on which printing based on a print job has been performed, and a liquid application unit that applies liquid onto the partition sheet.

11 Claims, 6 Drawing Sheets

PRINTING APPARATUS AND PARTITION SHEET OUTPUT METHOD

BACKGROUND

1. Technical Field

The present invention relates to a printing apparatus such as an ink jet printer, for example, and a partition sheet output method in the printing apparatus.

2. Related Art

The following existing image forming apparatus (printing apparatus) has been known (for example, JP-A-11-292381). That is, the image forming apparatus (printing apparatus) transfers a toner image formed on a surface of a photosensitive member by a developing device of an image forming unit onto output paper (medium) by a transfer unit, and then, fixes the toner image thereto by a fixing device while cutting roll paper into a specified length as the output paper. Thereafter, the image forming apparatus discharges the output paper on a discharge tray through a transportation roller and a paper discharge roller. In the image forming apparatus, an interleaf (partition sheet) larger than the output paper is discharged on the discharge tray every time image formation for one job in which images are formed on a plurality of sheets of output paper is completed. In this manner, a plurality of jobs are segmented one by one, so that the respective jobs are identified easily.

SUMMARY

Meanwhile, no image is printed or only characters of several words are printed on the interleaf in the above-mentioned image forming apparatus. Therefore, when the interleaf is heated by the fixing device, the interleaf is excessively dried and warpage thereof is large in comparison with the output paper on which the image has been formed in some cases. In particular, when printing is performed using liquid, the warpage tends to be large on a region to which the liquid is not applied.

Due to this, when the output paper is discharged on the discharge tray after the interleaf in a state where a rear end portion thereof is warped upwardly is discharged on the discharge tray, for example, the output paper discharged later enters the lower side of the interleaf in the upwardly warped state. This raises a problem that the order of the sheets of output paper stacked on the discharge tray becomes out-of-order.

An advantage of some aspects of the invention is to provide a printing apparatus and a partition sheet output method capable of suppressing warpage of a partition sheet.

Hereinafter, means and action effects thereof for achieving the above-mentioned advantage will be described.

A printing apparatus according to an aspect of the invention includes a drying unit that dries a medium, a controller that controls to output a partition sheet as a partition of the medium on which printing based on a print job has been performed, and a liquid application unit that applies liquid onto the partition sheet.

With this configuration, the liquid application unit applies the liquid onto the partition sheet. Therefore, excessively drying the partition sheet by the drying unit can be suppressed. Accordingly, warpage of the partition sheet can be suppressed.

In the above-mentioned printing apparatus, it is preferable that the liquid application unit be a discharge unit which discharges the liquid for performing printing on the medium, and the controller control the discharge unit to print a pattern by applying the liquid on the partition sheet.

With this configuration, the liquid which is discharged from the discharge unit for performing printing on the medium is applied onto the partition sheet. Therefore, excessively drying the partition sheet by the drying unit can be suppressed. Accordingly, warpage of the partition sheet can be suppressed.

In the above-mentioned printing apparatus, it is preferable that the pattern contain a rectangular shape having long sides in a direction intersecting with a transportation direction of the partition sheet.

With this configuration, the rectangular pattern having the long sides in the direction intersecting with the transportation direction of the partition sheet is present across a long range in the direction intersecting with the transportation direction. Therefore, warpage of the partition sheet in the direction intersecting with the transportation direction due to drying of the partition sheet can be suppressed.

In the above-mentioned printing apparatus, it is preferable that the pattern contain a rectangular shape having long sides in a direction along the transportation direction of the partition sheet.

With this configuration, the rectangular pattern having the long sides in the direction along the transportation direction of the partition sheet is present across a long range in the direction along the transportation direction. Therefore, warpage of the partition sheet in the direction along the transportation direction due to drying of the partition sheet can be suppressed.

In the above-mentioned printing apparatus, it is preferable that the pattern contain a geometric design.

With this configuration, the geometric pattern is printed on the partition sheet with liquid. Therefore, excessively drying the partition sheet by the drying unit can be suppressed while a liquid consumption amount is reduced in comparison with the case where the liquid is applied to the overall surface of the partition sheet.

In the above-mentioned printing apparatus, it is preferable that the pattern contain a character.

With this configuration, excessively drying the partition sheet by the drying unit can be suppressed while arbitrary character information is given to the partition sheet.

In the above-mentioned printing apparatus, it is preferable that the pattern contain a pattern which is formed by a discarding ejection of the liquid in order to suppress clogging of the discharge unit.

With this configuration, the pattern is formed on the partition sheet using the liquid discarded by the discharge unit, thereby using the liquid effectively.

In the above-mentioned printing apparatus, it is preferable that the pattern contain an advertisement.

With this configuration, excessively drying the partition sheet by the drying unit can be suppressed while the partition sheet is utilized as a medium for sales promotion and advertising.

In the above-mentioned printing apparatus, it is preferable that the pattern contain a test pattern for performing a test of the printing apparatus.

With this configuration, excessively drying the partition sheet by the drying unit can be suppressed while a test of the printing apparatus is performed using the partition sheet.

In the above-mentioned printing apparatus, it is preferable that the liquid application unit apply liquid, different from liquid for printing, onto the partition sheet.

With this configuration, the liquid for liquid application that is applied onto the partition sheet is prepared separately from the liquid for printing. Therefore, a consumption amount of the liquid for printing can be reduced.

A partition sheet output method in a printing apparatus according to another aspect of the invention is a partition sheet output method in a printing apparatus that outputs a partition sheet as a partition of a medium on which printing based on a print job has been performed, the method including applying liquid onto the partition sheet before drying the partition sheet.

With this configuration, the liquid is applied onto the partition sheet before the partition sheet is dried. Therefore, excessively drying the partition sheet can be suppressed. Accordingly, warpage of the partition sheet can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which a printing apparatus is used as an ink jet printer will be described with reference to the drawings.

Figure 1:
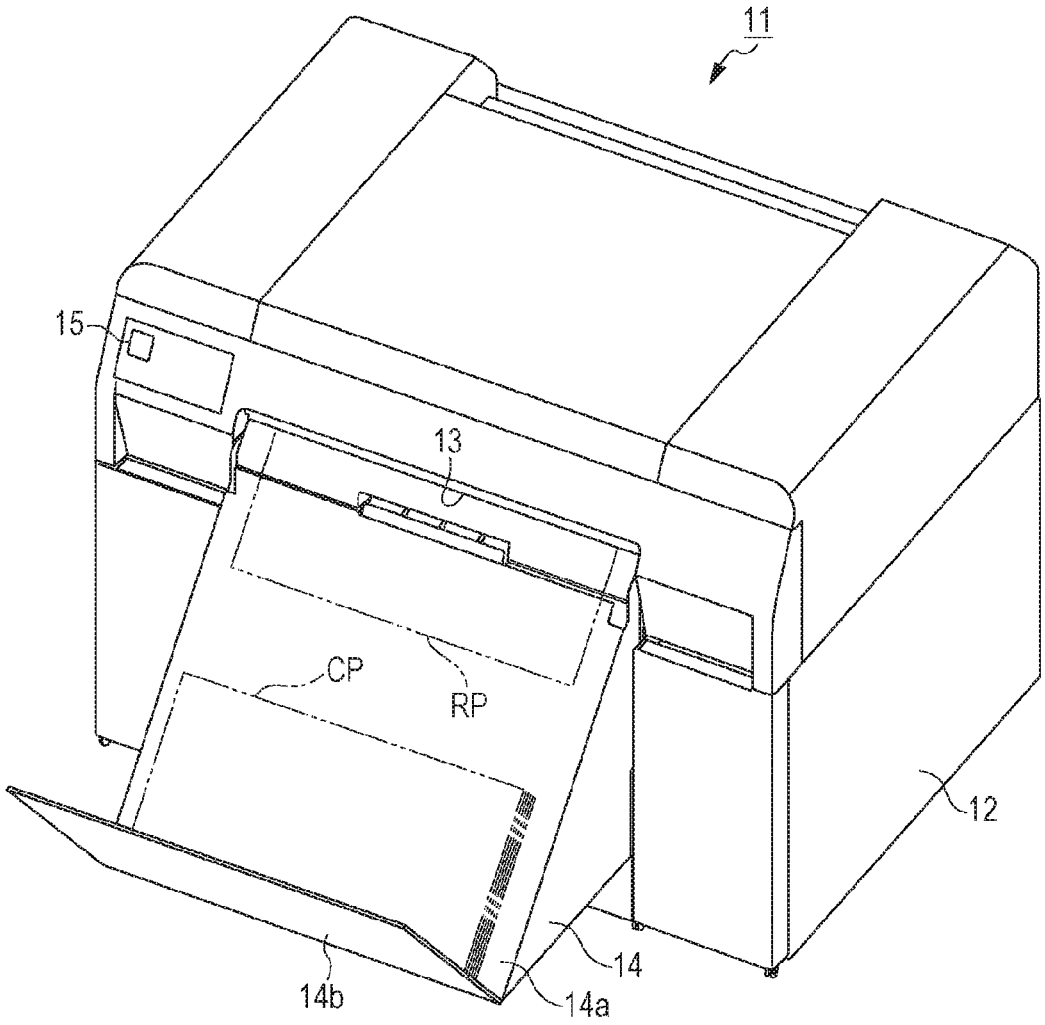
FIG. 1 is a perspective view of an ink jet printer according to an embodiment.

As illustrated in FIG. 1, an external device (not illustrated) can be connected to an ink jet printer 11 as an example of the printing apparatus and the ink jet printer 11 includes a housing portion 12 having a substantially rectangular parallelepiped shape, which configures an exterior of the ink jet printer 11. A discharge port 13 through which roll paper RP as an example of a medium is discharged is provided on a center portion of an upper end portion on the front surface of the housing portion 12. When printing is performed on the roll paper RP and the roll paper RP is discharged through the discharge port 13, the roll paper RP is cut into a predetermined length so as to obtain cut paper CP.

A stacker 14 is attached to the lower side of the discharge port 13 on the front surface of the housing portion 12 in a detachable manner. The stacker 14 supports the sheets of cut paper CP on which printing has been performed and that have been discharged through the discharge port 13 in a stacking manner in sequence. The stacker 14 includes an inclined surface 14*a* and an abutment plate 14*b*. The inclined surface 14*a* receives the cut paper CP on which printing has been performed and that has been discharged through the discharge port 13 and is inclined so as to be lower as it is distanced from the housing portion 12. The abutment plate 14*b* is provided on the lower end of the inclined surface 14*a* and the cut paper CP discharged on the inclined surface 14*a* abuts against the abutment plate 14*b*.

The abutment plate 14*b* is provided so as to be perpendicular to the inclined surface 14*a*. Accordingly, the cut paper CP on which printing has been performed and that has been discharged through the discharge port 13 is supported by the inclined surface 14*a* and the abutment plate 14*b*. It should be noted that an operation unit 15 for operating the ink jet printer 11 is provided on a corner portion of an upper end portion on the front surface of the housing portion 12.

Figure 2:
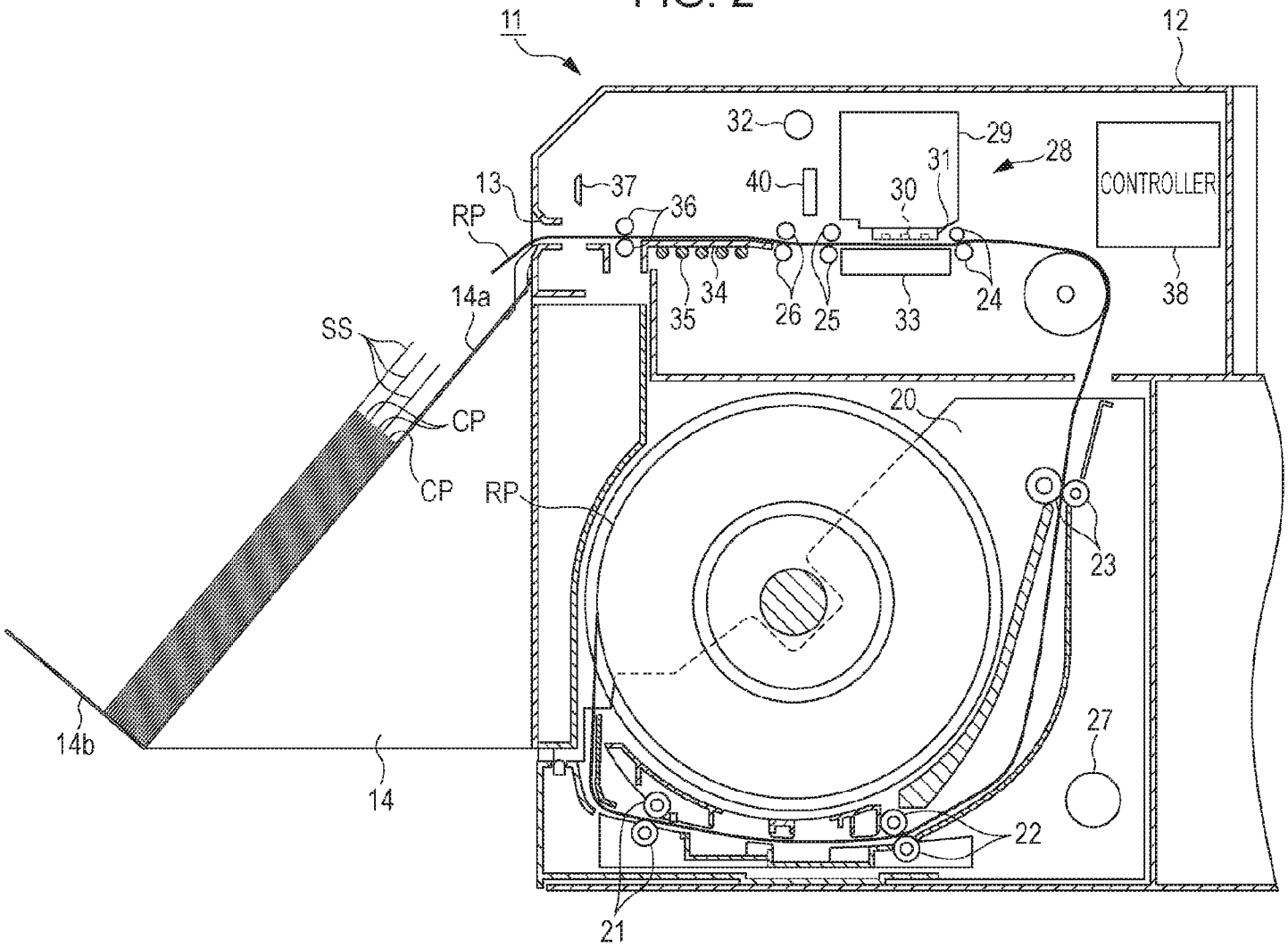
FIG. 2 is a schematic cross-sectional view of the printer.

As illustrated in FIG. 2, the roll paper RP is arranged in the housing portion 12 in a state of being supported by a roll paper holder 20. In this case, the roll paper holder 20 supports the roll paper RP such that the roll paper RP is rotatable about an axial line, as a rotating center, extending in the width direction (direction orthogonal to a paper plane in FIG. 2) of the housing portion 12.

Further, transportation rollers 21 to 23, paper feeding rollers 24, upstream-side paper discharge rollers 25, and downstream-side paper discharge rollers 26 that apply transportation force to the roll paper RP are provided in the housing portion 12 at appropriate intervals. These rollers are provided so as to be along a transportation path on which the roll paper RP unwound from a roll state is transported toward the downstream side at which the discharge port 13 is provided. These rollers 21 to 26 are rotationally driven by a transportation motor 27.

A printing unit 28 is provided in the housing portion 12 at an upper-side position relative to the roll paper holder 20. The printing unit 28 is an example of a discharge unit (liquid application unit) that discharges ink as an example of liquid and makes the ink adhere to the roll paper RP transported along the transportation path so as to perform printing. The printing unit 28 includes a carriage 29 and a discharge head 31. The carriage 29 can reciprocate in the width direction (direction orthogonal to the paper plane in FIG. 2) of the housing portion 12. The discharge head 31 is supported by a lower end portion of the carriage 29 and discharges the ink through a plurality of nozzles 30. The carriage 29 is made to reciprocate by driving of a carriage motor 32.

A support table 33 is arranged in the housing portion 12 at a position opposing the discharge head 31. The support table 33 supports a part of the roll paper RP on which ink is discharged from the discharge head 31. The paper feeding rollers 24 are arranged at the upstream side of the support table 33 and the upstream-side paper discharge rollers 25 are arranged at the downstream side of the support table 33 on the transportation path of the roll paper RP. The downstream-side paper discharge rollers 26 are arranged at the downstream side of the upstream-side paper discharge rollers 25 and a support plate 34 supporting the roll paper RP is arranged at the downstream side of the downstream-side paper discharge rollers 26 on the transportation path of the roll paper RP.

A heater 35 as an example of a drying unit is provided on a surface of the support plate 34 on the opposite side to a surface thereof supporting the roll paper RP. That is to say, the printing apparatus includes the drying unit that dries the medium. Accordingly, heat of the heater 35 transmits to the roll paper RP through the support plate 34, so that the roll paper RP on which printing has been performed is dried. Nipping rollers 36 which hold the roll paper RP therebetween are arranged at the downstream side of the support plate 34 and a cutter 37 which cuts the roll paper RP so as to obtain the cut paper CP is provided at the downstream side of the nipping rollers 36 on the transportation path of the roll paper RP.

The cutter 37 normally stands by at a position retreated from the transportation path of the roll paper RP and moves to the transportation path of the roll paper RP when cutting the roll paper RP. When the cutter 37 cuts the roll paper RP, the nipping rollers 36 hold and fix the roll paper RP therebetween at the upstream side relative to the cutting position of the roll paper RP. The cut paper CP obtained by cutting the roll paper RP with the cutter 37 is discharged on the stacker 14 through the discharge port 13.

Further, a controller 38 which integrally controls the overall ink jet printer 11 is provided in the housing portion 12. The controller 38 is electrically connected to the transportation motor 27, the carriage motor 32, the discharge head 31, and the cutter 37, and controls driving of the transportation motor 27, the carriage motor 32, the discharge head 31, and the cutter 37.

When the controller 38 receives a print job that is transmitted from an external device (not illustrated), the controller 38 controls driving of the transportation motor 27, the carriage motor 32, the discharge head 31, and the cutter 37 such that printing based on the received print job is performed on the roll paper RP and the roll paper RP on which printing has been performed is discharged as the cut paper CP onto the stacker 14 through the discharge port 13.

Then, when printing of the last page of one print job is finished, the controller 38 controls driving of the transportation motor 27, the carriage motor 32, the discharge head 31, and the cutter 37 such that a partition sheet SS obtained by cutting the roll paper RP so as to be longer than the cut paper CP is discharged (output) onto the stacker 14 through the discharge port 13. That is to say, the controller 38 controls to output the partition sheet SS as a partition of media on which printing has been performed based on the print job.

Next, operational actions of the ink jet printer 11 will be described.

When the ink jet printer 11 receives a print job that is transmitted from an external device (not illustrated) connected to the ink jet printer 11 by an operation of the operation unit 15, the rollers 21 to 26 are rotationally driven and the roll paper RP is transported to the downstream side along the transportation path. Subsequently, the ink is discharged onto the roll paper RP on the support table 33 through the respective nozzles 30 of the discharge head 31 while the carriage 29 reciprocates in the width direction (direction intersecting with the transportation direction of the roll paper RP) of the housing portion 12.

With this, the ink adheres to the roll paper RP on the support table 33, so that printing on the roll paper RP based on the print job is performed. Thereafter, the roll paper RP on which printing has been performed is transported to the downstream side of the transportation path. Heat generated by the heater 35 is applied to the roll paper RP and the roll paper RP is dried in a process of being transported on the support plate 34. Then, when the dried roll paper RP is discharged onto the stacker 14 through the discharge port 13, the roll paper RP is cut into the predetermined length with the cutter 37 in a state of being held between the nipping rollers 36 so as to obtain the cut paper CP. Accordingly, the roll paper RP that is discharged through the discharge port 13 at this time is supported on the stacker 14 as the cut paper CP.

In the same manner, when printing on the roll paper RP is performed and the sheets of cut paper CP are discharged onto the stacker 14 in sequence, the sheets of cut paper CP on which printing has been performed have been supported on the stacker 14 in a stacked state. Then, after the last-page printing of one print job (for example, printing of page 20 is performed when the print job is a 20-page print job), printing for forming the partition sheet SS is performed on the roll paper RP in order to partition the sheets of cut paper CP supported on the stacker 14 in the stacked state for each print job.

The partition sheet SS is formed by cutting the roll paper RP in the same manner as the cut paper CP and is set to be slightly longer than the cut paper CP. Then, a pattern for applying ink is printed on a part of the roll paper RP corresponding to the partition sheet SS.

Figure 3:
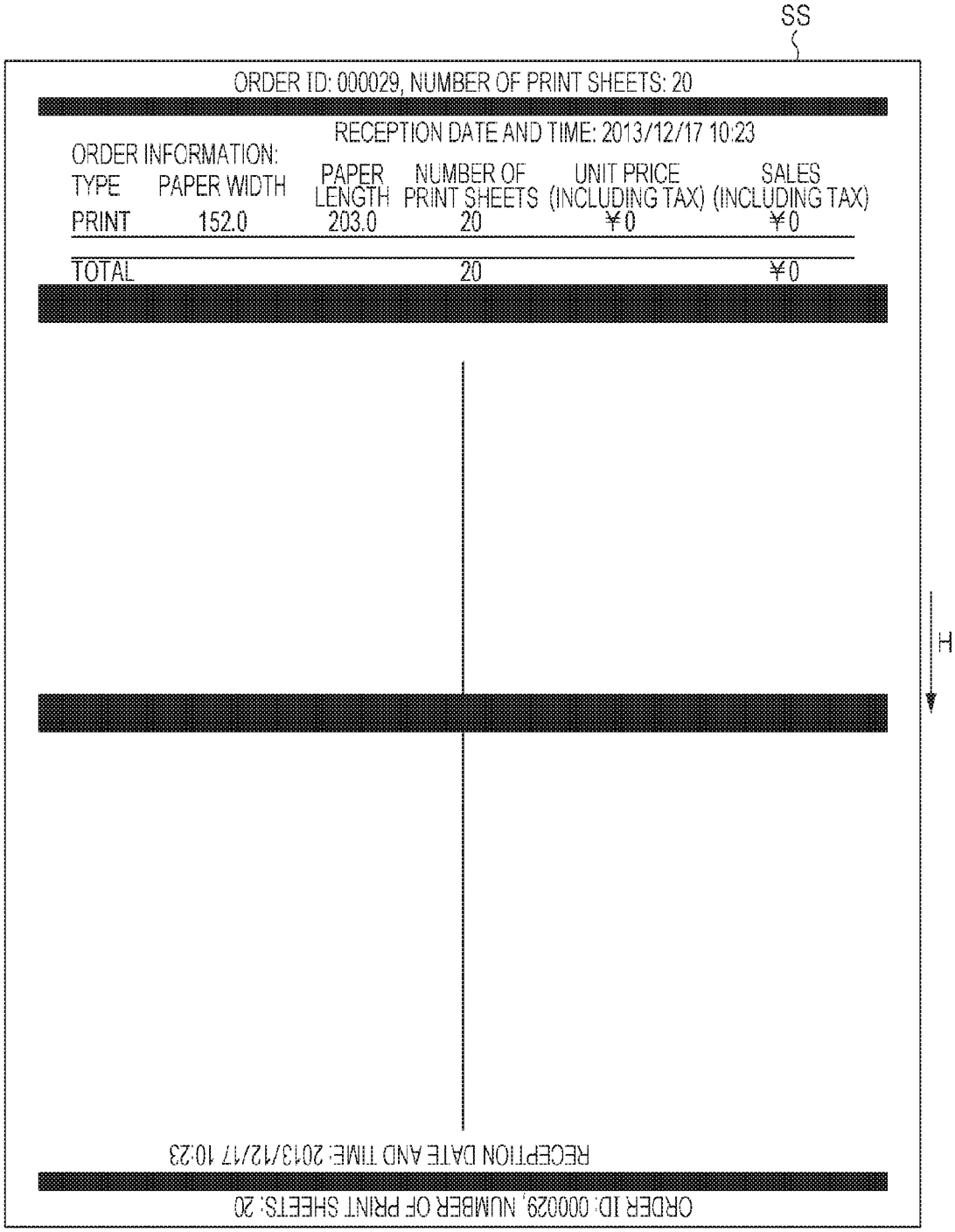
FIG. 3 is a plan view of a partition sheet.

In the embodiment, as illustrated in FIG. 3, the pattern that is printed on the part of the roll paper RP corresponding to the partition sheet SS, contains a plurality of (four in this example) rectangular shapes having long sides extending in the direction intersecting with (orthogonal to in this example) the transportation direction H of the roll paper RP and characters (order information in this example). In other words, the pattern contains the rectangular shapes having the long sides in the direction intersecting with the transportation direction H of the partition sheet SS.

These four rectangular shapes are entirely printed with the ink, and are printed from a front end portion to a rear end portion in the transportation direction H, at appropriate intervals, on the part of the roll paper RP corresponding to the partition sheet SS. That is to say, the four rectangular shapes are respectively printed on the front end portion, the rear end portion, and a center portion in the transportation direction H one by one, and a portion between the rear end portion and the center portion on the part of the roll paper RP corresponding to the partition sheet SS.

Further, a single line extending along the transportation direction H is printed across the center portion of the part of the roll paper RP corresponding to the partition sheet SS in the direction intersecting with the transportation direction H. The characters (order information) are printed along the rectangular shapes respectively printed on the front end portion and the rear end portion in the transportation direction H of the part of the roll paper RP corresponding to the partition sheet SS.

As illustrated in FIG. 2, when printing on the part of the roll paper RP corresponding to the partition sheet SS is finished, the part on which printing has been performed is transported to the downstream side. Heat generated by the heater 35 is applied to the part and the part is dried in a process of being transported on the support plate 34. When the part of the dried roll paper RP corresponding to the partition sheet SS is discharged onto the stacker 14 through the discharge port 13, the part of the dried roll paper RP is cut into a predetermined length slightly longer than the cut paper CP with the cutter 37 in a state of being held between the nipping rollers 36 so as to obtain the partition sheet SS. Accordingly, the roll paper RP discharged through the discharge port 13 at this time is arranged as the partition sheet SS at the uppermost side of a plurality of sheets of cut paper CP on which printing has been performed for one print job and which have been supported by the stacker 14.

In the same manner, when a plurality of print jobs are processed in sequence, the sheets of cut paper CP for the plurality of print jobs are supported on the stacker 14 in a stacked state. Printing of the partition sheet SS as a partition is performed every time one print job is finished. Therefore, the plurality of sheets of cut paper CP on which printing has been performed by the plurality of print jobs are partitioned into the sets of cut paper CP of the respective print jobs by the partition sheets SS. Accordingly, even when the plurality of print jobs are processed continuously, the plurality of print jobs are easy to be identified individually.

In the case where no printing is performed on the part of the roll paper RP corresponding to the partition sheet SS, when heat of the heater 35 is applied thereto, the stated part is excessively dried. Due to this, when the part of the roll paper RP corresponding to the partition sheet SS is cut and discharged as the partition sheet SS onto the cut paper CP supported on the stacker 14, the partition sheet SS is warped.

In particular, when the rear side of the partition sheet SS in the transportation direction H is warped upwardly, the cut paper CP on which printing has been performed in a subsequent print job enters the lower side of the partition sheet SS the rear side of which has been warped upwardly. For this reason, the plurality of print jobs cannot be partitioned for the respective print jobs by the partition sheets SS.

In contrast, in the embodiment, the rectangular shapes having the long sides extending in the direction intersecting with the transportation direction H are printed on four places including the rear end portion in the transportation direction H of the part of the roll paper RP corresponding to the partition sheet SS. With this, even when heat of the heater 35 is applied to the part of the roll paper RP corresponding to the partition sheet SS, excessively drying the stated part is suppressed. That is to say, ink is applied to the part of the roll paper RP corresponding to the partition sheet SS and printing is performed thereon before the stated part of the roll paper RP is dried with heat of the heater 35. Therefore, excessively drying the part of the roll paper RP corresponding to the partition sheet SS is suppressed.

In other words, liquid is applied to the partition sheet SS and the printing unit 28 as an example of a liquid application unit applies the liquid. That is to say, the printing apparatus can be considered to include the liquid application unit that applies the liquid onto the partition sheet SS. In the embodiment, the liquid application unit is a discharge unit that discharges the liquid in order to perform printing on a medium. The controller 38 causes the discharge unit to print the pattern for applying the liquid on the partition sheet SS.

Accordingly, when the part of the roll paper RP corresponding to the partition sheet SS is cut and discharged (output) as the partition sheet SS onto the cut paper CP supported on the stacker 14, warpage of the partition sheet SS is suppressed. Therefore, entrance of the cut paper CP on which printing has been performed by a subsequent print job into the lower side of the partition sheet SS is suppressed.

The embodiment as described in detail above can achieve the following effects.

1. The ink jet printer 11 includes the heater 35 that dries the roll paper RP, the controller 38 that controls to output the partition sheet SS as a partition of the cut paper CP (roll paper RP) on which printing based on a print job has been performed, and the discharge head 31 that discharges ink onto the partition sheet SS to print a pattern. With this, the pattern is printed on the partition sheet SS with the ink discharged from the discharge head 31, so that the ink is applied onto the partition sheet SS. Therefore, excessively drying the partition sheet SS after printing with heat of the heater 35 can be suppressed. That is to say, contraction of the partition sheet SS with the heat of the heater 35 can be suppressed with the ink applied onto the partition sheet SS. Accordingly, warpage of the partition sheet SS can be suppressed. Further, the pattern is printed on the partition sheet SS, so that a weight of the partition sheet SS can be increased by the ink that is applied onto the partition sheet SS. Accordingly, the partition sheet SS is made difficult to be warped.

When the embodiment is expressed as a method of outputting the partition sheet SS, there is provided a method of outputting the partition sheet SS in the printing apparatus that outputs the partition sheet SS as a partition of the medium on which printing based on a print job has been performed, the method including applying liquid onto the partition sheet SS before drying it. Also with this method, the liquid is applied onto the partition sheet SS before the partition sheet SS is dried. Therefore, excessively drying the partition sheet SS is suppressed. Accordingly, warpage of the partition sheet SS can be suppressed.

2. In the ink jet printer 11, the pattern that is printed on the partition sheet SS contains the rectangular shapes having the long sides extending in the direction intersecting with the transportation direction H of the partition sheet SS (roll paper RP). With this, the rectangular patterns printed on the partition sheet SS are present across a long range in the direction intersecting with the transportation direction H. Therefore, warpage of the partition sheet SS in the direction intersecting with the transportation direction H due to drying of the partition sheet SS with heat of the heater 35 can be suppressed.

3. In the ink jet printer 11, the pattern that is printed on the partition sheet SS contains characters. Therefore, excessively drying the partition sheet SS on which printing has been performed with heat of the heater 35 can be suppressed while character information is given to the partition sheet SS.

4. In the ink jet printer 11, the pattern that is printed on the partition sheet SS contains a single line extending along the transportation direction H. With this, transportation time for printing on the partition sheet SS can be made longer. Accordingly, the transportation time for printing on the partition sheet SS can be made close to the transportation time for printing on the cut paper CP.

Variations

The above-mentioned embodiment may be changed in the following manner.

Figure 4:
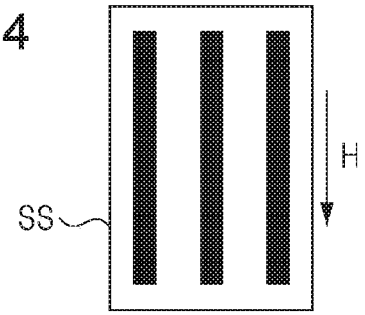
FIG. 4 is a schematic plan view of a partition sheet according to a variation.

As illustrated in FIG. 4, the pattern that is printed on the partition sheet SS may contain rectangular shapes having long sides extending in the direction along the transportation direction H of the partition sheet SS (roll paper RP). In other words, the pattern may contain the rectangular shapes having the long sides in the direction along the transportation direction H of the partition sheet SS. With this, the rectangular patterns printed on the partition sheet SS are present across a long range in the direction along the transportation direction H. Therefore, warpage of the partition sheet SS in the direction along the transportation direction H due to drying of the partition sheet SS with heat of the heater 35 can be suppressed.

Figure 5A:
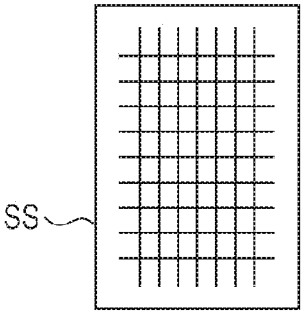
FIGS. 5A to 5F are schematic plan views of a partition sheet according to another variation.
Figure 5B:
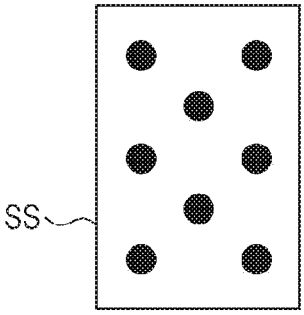
Figure 5C:
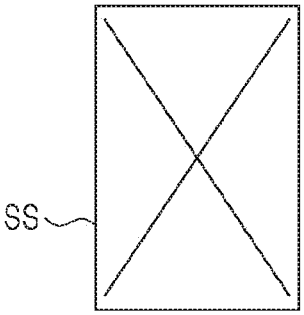
Figure 5D:
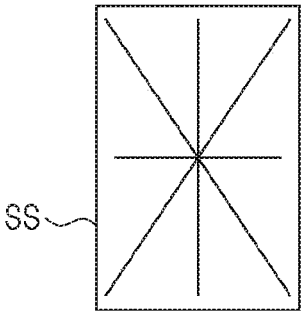
Figure 5E:
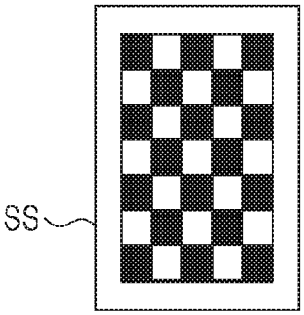
Figure 5F:
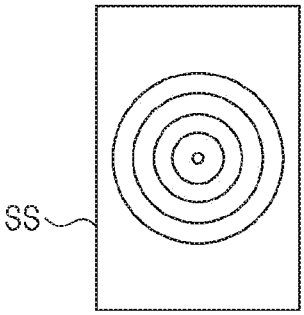

As illustrated in FIGS. 5A to 5F, the pattern that is printed on the partition sheet SS may contain a geometric design. Note that FIG. 5A illustrates a lattice design, FIG. 5B indicates a polka-dot design, FIG. 5C indicates a cross mark design, FIG. 5D indicates what is called a Union Jack-like design in which a cross mark and a plus mark are superimposed, FIG. 5E illustrates a checker-board design, and FIG. 5F illustrates a ripple design. With them, excessively drying the partition sheet SS with heat of the heater 35 can be suppressed while an ink consumption amount can be reduced in comparison with the case where ink is applied to the overall surface of the partition sheet SS.

Figure 6A:
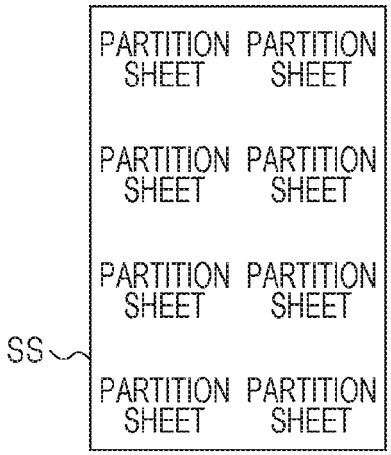
FIGS. 6A and 6B are schematic plan views of a partition sheet according to still another variation.
Figure 6B:
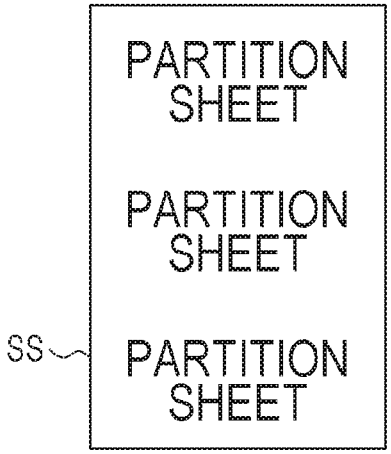

As illustrated in FIG. 6A and FIG. 6B, the pattern that is printed on the partition sheet SS may contain characters. In this case, as illustrated in FIG. 6A, the number of characters may be increased while the font of the characters is made smaller. Alternatively, as illustrated in FIG. 6B, the number of characters may be decreased while the font of the characters is made larger. It should be noted that the type, contents, and layout of the characters may be arbitrarily changed. With this, excessively drying the partition sheet SS on which printing has been performed with heat of the heater 35 can be suppressed while character information is applied to the partition sheet SS.

Figure 7:
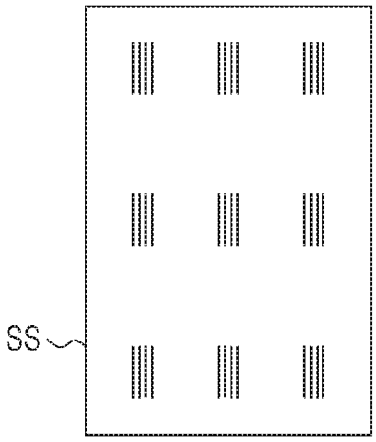
FIG. 7 is a schematic plan view of a partition sheet according to still another variation.

As illustrated in FIG. 7, the pattern that is formed on the partition sheet SS may contain a pattern of a flushing operation (discarding ejection) for discharging the ink in order to suppress clogging of the nozzles 30 regardless of printing through all the nozzles 30 of the discharge head 31. In other words, the pattern may contain a pattern that is formed by the discarding ejection of the liquid in order to suppress clogging of the discharge unit. That is to say, the flushing operation may be performed on the partition sheet SS. With this, the ink (ink to be discarded) that is discharged and discarded by the flushing operation through all the nozzles 30 of the discharge head 31 can be used effectively.

Figure 8:
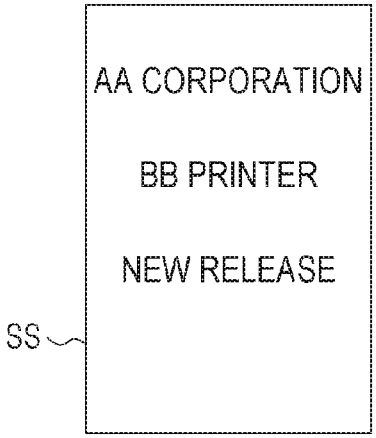
FIG. 8 is a schematic plan view of a partition sheet according to still another variation.

As illustrated in FIG. 8, the pattern that is printed on the partition sheet SS may contain an advertisement. With this, excessively drying the partition sheet SS with heat of the heater 35 can be suppressed while the partition sheet SS is utilized as a medium for sales promotion and advertising. Although the advertisement illustrated in FIG. 8 is formed by characters, it may contain an image.

Figure 9:
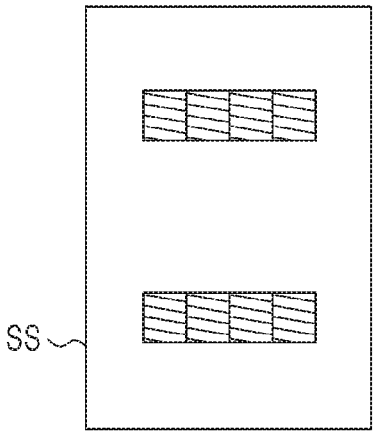
FIG. 9 is a schematic plan view of a partition sheet according to still another variation.

As illustrated in FIG. 9, the pattern that is printed on the partition sheet SS may contain a test pattern for performing a test of the ink jet printer 11. In other words, the pattern may contain a test pattern for performing a test of the printing apparatus. With this, excessively drying the partition sheet SS with heat of the heater 35 can be suppressed while the test of the ink jet printer 11 is performed using the partition sheet SS. FIG. 9 illustrates a test pattern for nozzle-failure (test pattern for checking presence of a non-discharging nozzle) on the partition sheet SS. Note that the test pattern may be a pattern for checking a transportation amount error of the roll paper RP, measuring colors, or checking deviation of an ink discharge timing.

As for the pattern that is printed on the partition sheet SS, any one pattern among the plurality of examples as described above may be printed or the plurality of patterns may be printed appropriately in combination.

As illustrated in FIG. 2, a liquid application unit 40 that applies liquid for liquid application, such as water, oil, or the like which is different from the ink (liquid for printing), onto the roll paper RP between the support plate 34 and the support table 33 or on the support plate 34 in the transportation path of the roll paper RP, may be arranged. That is to say, the printing apparatus may include the liquid application unit 40 that applies the liquid, different from the liquid for printing, onto the partition sheet SS. With this, the liquid (for example, water, oil, or the like) for liquid application, which is to be applied onto the partition sheet SS, is prepared separately from the ink as the liquid for printing, thereby reducing the ink consumption amount. In this case, the liquid application unit 40 may discharge or apply the liquid for liquid application onto the part of the roll paper RP corresponding to the partition sheet SS.

Cut-form paper may be used as the medium instead of the roll paper RP. In this case, the partition sheet SS and the paper for printing are formed by the sheets of cut-form paper having the same size. Alternatively, the length of the paper for printing may be made shorter than the length of the partition sheet SS by cutting a part of the paper for printing with the cutter 37. Further, a material other than paper, such as a fabric, may be used as the medium.

The ink jet printer 11 may be changed to what is called a line head type printer including a long fixed liquid droplet discharge unit corresponding to the overall width of the roll paper RP. The liquid droplet discharge unit in this case may be configured such that a print range thereof is set to cover the overall width of the roll paper RP by arranging in parallel a plurality of unit head portions in which nozzles are formed or arranging a large number of nozzles in a single long head so as to cover the overall width of the roll paper RP.

In the above-mentioned embodiment, the printing apparatus may be a liquid droplet discharge apparatus that discharges liquid other than ink. A state of liquid which is discharged from the liquid droplet discharge apparatus as a trace amount of liquid droplets includes a granule form, a teardrop form, and a form that pulls tails in a string-like form therebehind. The terminology "liquid" here represents materials which can be discharged from the liquid droplet discharge apparatus. Any materials are included as long as the materials are in a liquid phase. For example, materials in a liquid state having high viscosity or low viscosity and materials in a fluid state such as sol, gel water, other inorganic solvents, an organic solvent, a solution, a liquid resin, and a liquid metal (molten metal) can be included as the liquid. Further, the liquid is not limited to liquid as one state of a material and includes a solution, a dispersion or a mixture of particles of a functional material made of a solid material such as pigment or metal particles in a solvent.

Typical examples of the liquid are ink described in the above-mentioned embodiments and liquid crystals.

The terminology "ink" here encompasses various liquid compositions such as common aqueous ink and oil ink, gel ink, hot melt ink, and so on. Specific examples of the liquid droplet discharge apparatus include a liquid droplet discharge apparatus which discharges liquid in a form of a dispersion or a solution of a material such as an electrode material or a coloring material. The material such as the electrode material or the coloring material is used for manufacturing a liquid crystal display, an electroluminescence (EL) display, a surface emitting display or a color filter, for example. Further, the specific examples of the liquid droplet discharge apparatus may include a liquid droplet discharge apparatus which discharges a bioorganic material to be used for manufacturing a biochip, a liquid droplet discharge apparatus to be used as a precision pipette which discharges liquid serving as a sample, a printing device, a micro dispenser, and so on. Other examples of the liquid droplet discharge apparatus may include a liquid droplet discharge apparatus which pinpoint-discharges lubricating oil into a precision machine such as a watch, a camera, or the like. Further, a liquid droplet discharge apparatus which discharges a transparent resin liquid of an ultraviolet curing resin or the like onto a substrate in order to form a hemispherical microlens (optical lens) to be used as an optical communication element or the like may be included as the liquid droplet discharge apparatus. In addition, a liquid droplet discharge apparatus which discharges an acid or alkali etching liquid for etching a substrate or the like may be included as the liquid droplet discharge apparatus.

The entire disclosure of Japanese Patent Application No. 2015-012139, filed Jan. 26, 2015 is expressly incorporated reference herein.

What is claimed is:

1. A printing apparatus comprising:

a drying unit that dries a medium;

a controller that controls to output a partition sheet as a partition of the medium on which printing based on a print job has been performed; and a liquid application unit that applies liquid onto the partition sheet, the liquid applied to the partition sheet being distributed on the partition sheet such that the partition sheet does not warp during drying.

2. The printing apparatus according to claim 1, wherein the liquid application unit is a discharge unit which discharges the liquid for performing printing on the medium, and the controller controls the discharge unit to print a pattern by applying the liquid on the partition sheet.

3. The printing apparatus according to claim 2, wherein the pattern contains a rectangular shape having long sides in a direction intersecting with a transportation direction of the partition sheet.

4. The printing apparatus according to claim 2, wherein the pattern contains a rectangular shape having long sides in a direction along the transportation direction of the partition sheet.

5. The printing apparatus according to claim 2, wherein the pattern contains a geometric design.

6. The printing apparatus according to claim 2, wherein the pattern contains a character.

7. The printing apparatus according to claim 2, wherein the pattern contains a pattern which is formed by a discarding ejection of the liquid in order to suppress clogging of the discharge unit.

8. The printing apparatus according to claim 2, wherein the pattern contains an advertisement.

9. The printing apparatus according to claim 2, wherein the pattern contains a test pattern for performing a test of the printing apparatus.

10. The printing apparatus according to claim 1, wherein the liquid application unit applies liquid, different from liquid for printing, onto the partition sheet.

11. A partition sheet output method in a printing apparatus that outputs a partition sheet as a partition of a medium on which printing based on a print job has been performed, the method comprising applying liquid onto the partition sheet before drying the partition sheet, wherein, in the applying step, the liquid is distributed on the partition sheet such that the partition sheet does not warp during drying.

* * * * *